US009238474B1

(12) United States Patent
Carpenter

(10) Patent No.: US 9,238,474 B1
(45) Date of Patent: Jan. 19, 2016

(54) RUN-THROUGH SWITCH RODS

(71) Applicant: Norfolk Southern Corporation, Norfolk, VA (US)

(72) Inventor: Bruce A Carpenter, Wapakoneta, OH (US)

(73) Assignee: Norfolk Southern Corporation, Norfolk, VA (US)

( * ) Notice: Subject to any disclaimer, the term of this patent is extended or adjusted under 35 U.S.C. 154(b) by 240 days.

(21) Appl. No.: 13/922,841

(22) Filed: Jun. 20, 2013

(51) Int. Cl.
*B61L 5/10* (2006.01)
*B61L 5/02* (2006.01)

(52) U.S. Cl.
CPC .... *B61L 5/02* (2013.01); *B61L 5/10* (2013.01)

(58) Field of Classification Search
CPC ..... B61L 5/10; B61L 5/02
USPC ..... 246/448, 452, 318
See application file for complete search history.

(56) References Cited

U.S. PATENT DOCUMENTS

| | | | | |
|---|---|---|---|---|
| 941,813 | A | 11/1909 | Raiter | |
| 1,312,813 | A * | 8/1919 | Spencer | 246/448 |
| 1,383,334 | A | 7/1921 | Partington | |
| 1,437,226 | A | 11/1922 | Chini | |
| 1,446,743 | A * | 2/1923 | Fisher | 246/158 |
| 1,479,403 | A * | 1/1924 | Veazey | 246/448 |
| 1,678,618 | A * | 7/1928 | Preston | 246/318 |
| 1,802,406 | A | 4/1931 | Dale | |
| 1,830,803 | A | 11/1931 | McWhirter | |
| 1,869,604 | A | 8/1932 | McWhirter | |
| 1,869,605 | A | 8/1932 | McWhirter | |
| 2,116,495 | A | 5/1938 | Adams | |
| 2,235,031 | A | 3/1941 | McGowan | |
| 2,380,820 | A | 7/1945 | Bone | |
| 2,468,024 | A | 4/1949 | Blythe | |
| 2,598,495 | A | 5/1952 | Bone et al. | |
| 2,747,860 | A | 5/1956 | McGowan | |
| 4,842,225 | A * | 6/1989 | Carmes | 246/439 |
| 5,566,912 | A | 10/1996 | Durchschlag | |
| 6,616,105 | B2 | 9/2003 | Grunwald et al. | |
| 6,691,958 | B2 * | 2/2004 | Biagiotti | 246/415 R |
| 7,104,508 | B1 | 9/2006 | Delaware | |

* cited by examiner

*Primary Examiner* — Zachary Kuhfuss
(74) *Attorney, Agent, or Firm* — Goodwin Procter LLP

(57) ABSTRACT

Embodiments of innovative designs and use of switch rods are disclosed. In one particular embodiment, a method of preventing derailment of a train traveling through a previously run-through railroad switch may include installing a railroad switch rod assembly to couple a switch point of a railroad switch with a railroad switch stand. The method may also include configuring a locking mechanism in the railroad switch rod assembly such that, upon a railway vehicle trailing the railroad switch in a first direction, the locking mechanism maintains the railroad switch in a condition that accommodates safe movement of the railway vehicle through the railroad switch in a second direction opposite to the first direction.

12 Claims, 16 Drawing Sheets

RUN-THROUGH SWITCH RODS

FIELD OF THE INVENTION

The present invention relates generally to railway equipment. More particularly, the present invention relates to innovative designs and use of switch rods to prevent derailment of a train that reverses through a previously trailed railroad switch.

BACKGROUND OF THE INVENTION

A railroad switch is a well-known mechanical installation that enables railway trains to be guided from one set of tracks to another set of tracks.

FIGS. 1A-1B show a typical railroad switch located at the intersection of main tracks 101 and secondary tracks 102. The railroad switch has switch points 104 which are mechanically linked so that they move together when toggled from one position to another. As a train approaches the railroad switch along the main tracks 101 and in the facing-point direction, the train wheels are guided along the route determined by which of the two switch points 104 is connected to the track facing the switch. If the left point is connected, as shown in FIG. 1A, then the left wheels of the train will be guided along the rail of that point, and the train will diverge to the right onto the secondary tracks 102. If the right point is connected, as shown in FIG. 1B, then the right wheels will be guided along the rail of that point, and the train will continue along the main tracks 101. The mechanical link between the switch points 104 ensures that only one of them may be connected to the facing track at any given time.

In FIG. 1A, if the train travels on the secondary tracks 102 but in the trailing-point direction, when the left point of the switch is connected, the train will continue onto the main tracks 101 without any issue. However, if the train travels on the main tracks 101 in the trailing-point direction, while the left point of the switch is connected, the train wheels will force the switch points 104 to switch to the right to allow the train to continue through on the main tracks. Such trailing of an open switch is referred to as a "run-through." A similar run-through could occur from the secondary tracks 102 when the switch is configured to allow train movements along the main tracks 101, as shown in FIG. 1B.

After a railroad switch has been run through, it could be in one of a number of conditions. Assuming the switch is in the condition as shown in FIG. 1A before the run-through, FIGS. 2A-2B show potential conditions of the switch after the run-through. For example, the switch may return to its previous position as set before the run-through, which is shown in FIG. 2A. For another example, the switch may be damaged by the run-through and rest in an "in-between" position that connects neither the main tracks nor the secondary tracks, as is shown in FIG. 2B. Even if the switch remains connected in the run-through position (in this case, switched to the right side like in FIG. 1B), the points are usually not tightly closed or locked in that position.

These post-run-through switch conditions may be problematic if a train somehow moves in reverse through the switch. For example, if the switch is damaged and remains in an "in-between" position as shown in FIG. 2B (or otherwise not securely closed or locked in the run-through position), the train wheels moving in reverse (i.e., in facing-point direction) will not be properly guided by the switch, which could cause derailment of the train. Even if the switch has returned to its pre-run-through position as shown in FIG. 2A, the reversing train could travel too fast for the switched curve to the secondary tracks, again potentially causing derailment.

In view of the foregoing, it may be understood that there are significant problems and shortcomings associated with current railroad switches.

SUMMARY OF THE INVENTION

Embodiments of innovative designs and use of switch rods are disclosed. In one particular embodiment, a method of preventing derailment of a train traveling through a previously run-through railroad switch may include installing a railroad switch rod assembly to couple a switch point of a railroad switch with a railroad switch stand. The method may also include configuring a locking mechanism in the railroad switch rod assembly such that, upon a railway vehicle trailing the railroad switch in a first direction, the locking mechanism maintains the railroad switch in a condition that accommodates safe movement of the railway vehicle through the railroad switch in a second direction opposite to the first direction.

In another embodiment, a detent assembly may be provided in the locking mechanism to restrict movement of a switch rod of the railroad switch rod assembly. In an alternative embodiment, at least one shear pin may be provided in the locking mechanism, the at least one shear pin configuring at least one spring to initially maintain the railroad switch in a first operating state and, when the at least one shearing pin breaks due to the run-through by the railway vehicle, to maintain the railroad switch in a second operating state.

In another particular embodiment, a railroad switch rod assembly may include a switch rod housing having a first end adapted to couple with a railroad switch stand, the switch rod housing further having a second end adapted to slidably receive a connecting rod into the switch rod housing. The railroad switch rod assembly may also include a detent assembly coupled to the switch rod housing, the detent assembly comprising a detent pin. The railroad switch rod assembly may further include the connecting rod, one end of the connecting rod being adapted to couple with a switch point of a railroad switch, the connecting rod having (a) a first notch to receive a tip of the detent pin in a first operating state of the railroad switch to maintain a first relative position of the connecting rod in the switch rod housing and (b) a second notch to receive the tip of the detent pin in a second operating state of the railroad switch to maintain a second relative position of the connecting rod in the switch rod housing.

In yet another embodiment, a railroad switch system may be made or modified to include any of the above-mentioned embodiments of the railroad switch rod assembly.

The present invention will now be described in more detail with reference to exemplary embodiments thereof as shown in the accompanying drawings. While the present invention is described below with reference to exemplary embodiments, it should be understood that the present invention is not limited thereto. Those of ordinary skill in the art having access to the teachings herein will recognize additional implementations, modifications, and embodiments, as well as other fields of use, which are within the scope of the present invention as described herein, and with respect to which the present invention may be of significant utility.

BRIEF DESCRIPTION OF THE DRAWINGS

In order to facilitate a fuller understanding of the present invention, reference is now made to the accompanying drawings, in which like elements are referenced with like numerals. These drawings should not be construed as limiting the present invention, but are intended to be exemplary only.

DETAILED DESCRIPTION OF THE INVENTION

Embodiments of the present invention provide for innovative designs and use of switch rods to prevent derailment of a train that traverses through a previously trailed railroad switch. In light of uncertain, and sometimes dangerous, conditions of the railroad switch after it has been run through by a trailing train, the inventor finds it desirable to have a switch that securely maintains or locks the switch points in the position forced by the run-through, rather than reverting to the position set before the run-through (or to any other position). A mechanism is therefore provided in the switch rod to accommodate a run-through and thereafter automatically cause the switch to remain in the same condition forced by the run-through. As a result of the design and use of the inventive switch rod assembly, the non-ideal conditions of the post-run-through railroad switch can be avoided, thereby eliminating or reducing the risk of derailment when a train attempts to traverse through a previously trailed railroad switch.

Other features and advantages of the present invention may be appreciated from the following illustration and description.

Figure 1A:
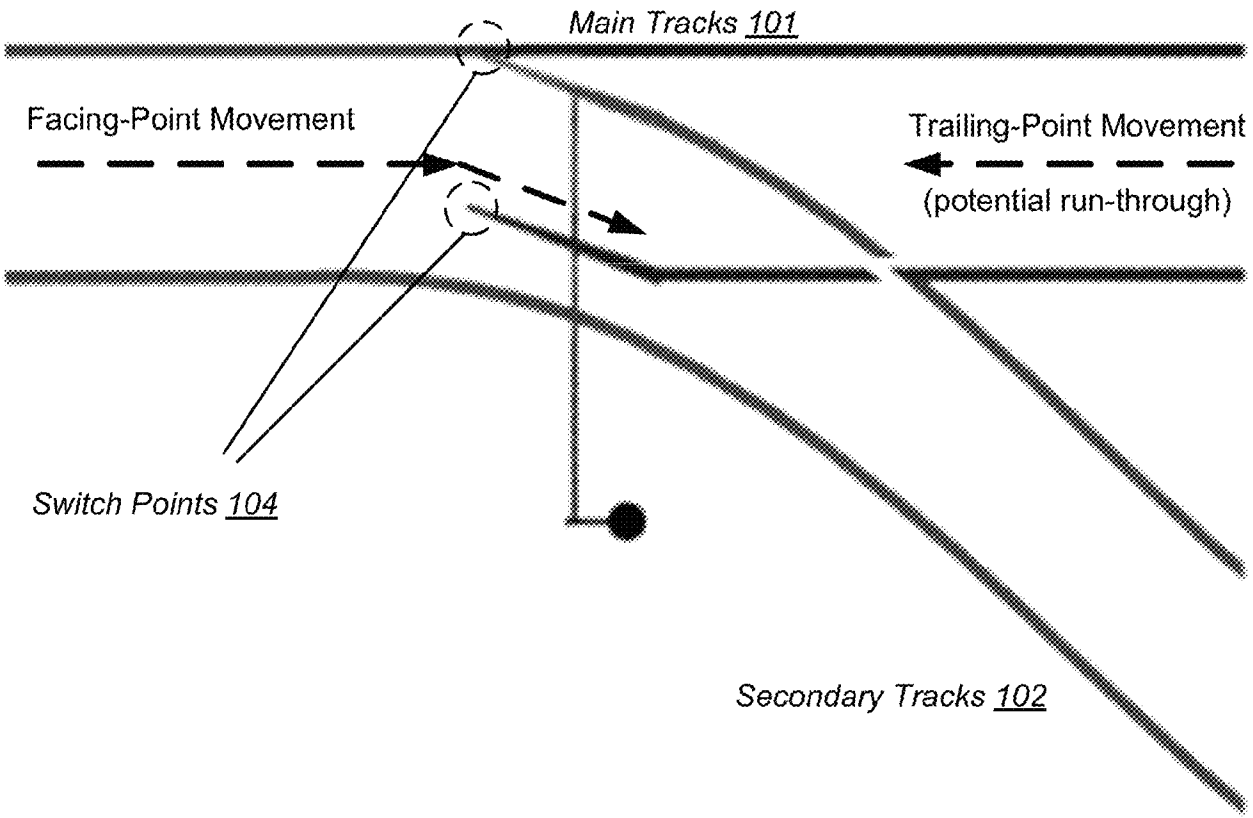
FIG. 1A (Prior Art)
FIGS. 1A-1B show a typical railroad switch known in the art.
Figure 1B:
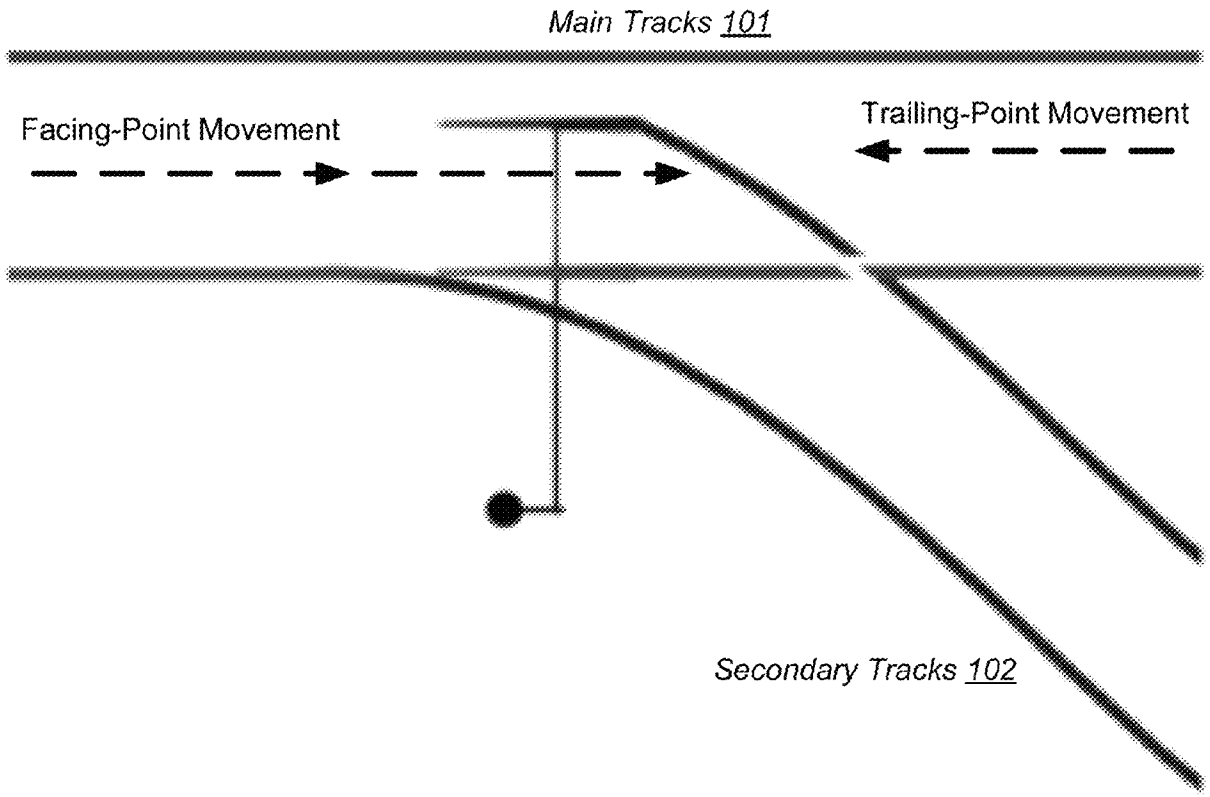
FIG. 1B (Prior Art)
Figure 2A:
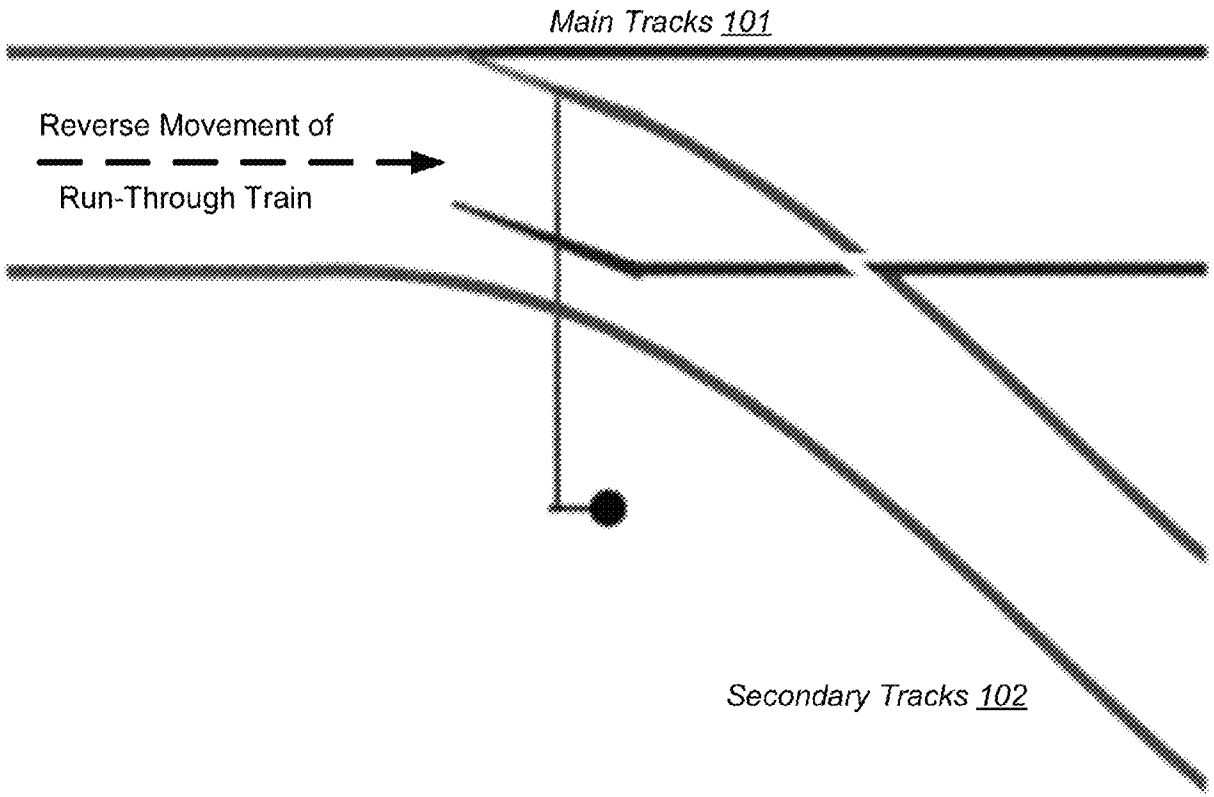
FIG. 2A (Prior Art)
FIGS. 2A-2B show potential conditions of a railroad switch after a run-through has occurred.
Figure 2B:
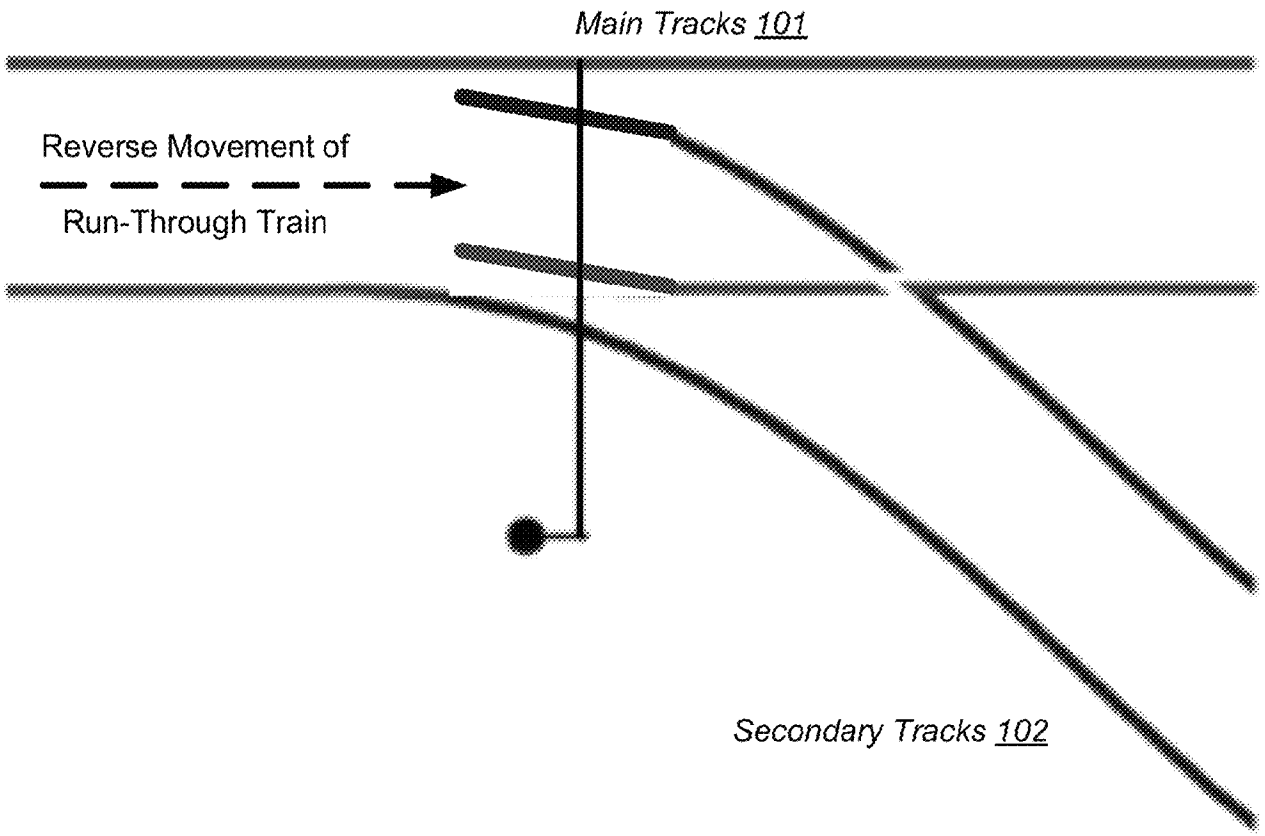
FIG. 2B (Prior Art)
Figure 3:
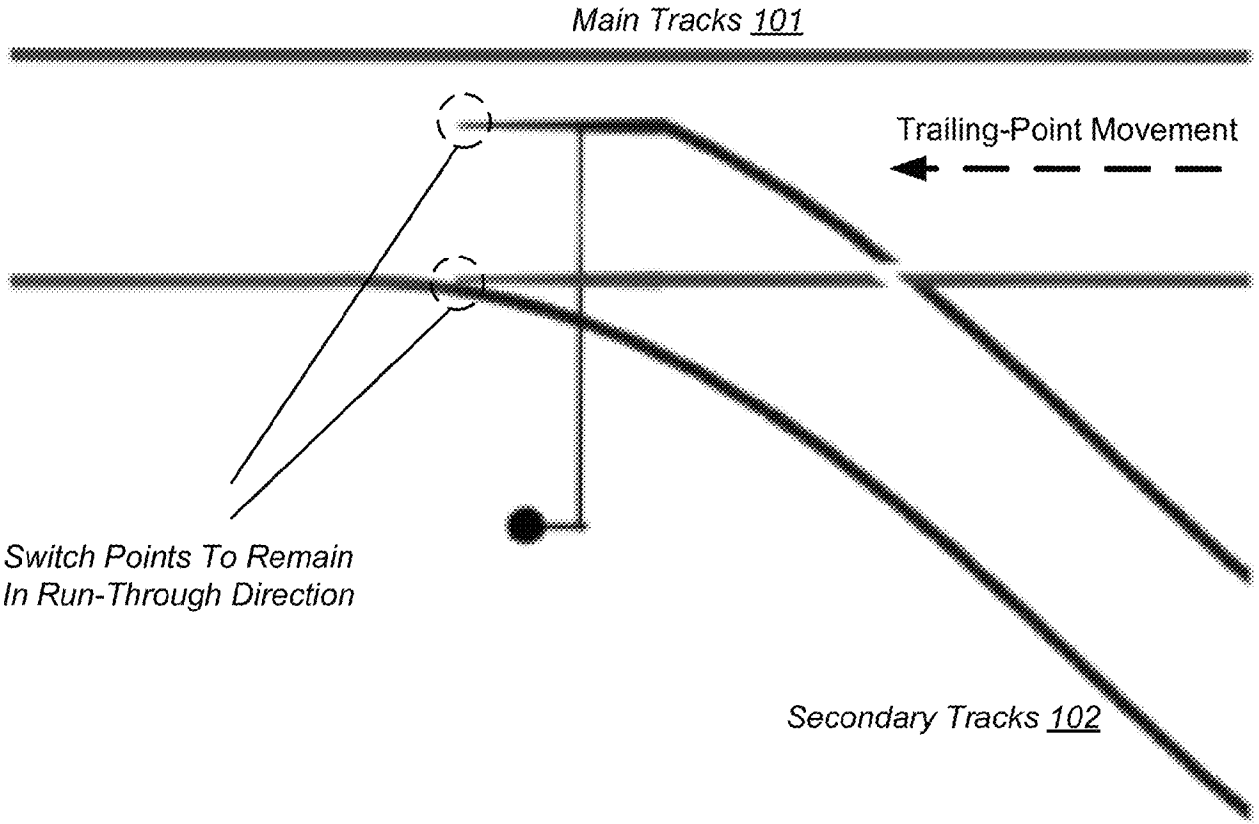
FIG. 3 shows a diagram illustrating a desired state of a railroad switch after a run-through in accordance with an embodiment of the present invention.

Referring to FIG. 3, there is shown a diagram illustrating a desired state of a railroad switch after a run-through in accordance with an embodiment of the present invention. Continuing with the example shown in FIG. 2A, it is assumed that a train has run through a railroad switch along main tracks 101 in the trailing-point direction as shown. The railroad switch according to the present invention will be so designed and/or configured to cause the switch points to remain locked in the run-through direction such that no derailment would occur if the same train backs up or another train comes in the opposite (facing-point) direction through the switch.

A number of methods may be effective in causing the switch points to be locked in place after a run-through. According to embodiments of the present invention, it may be desirable to provide a locking mechanism in the switch rod that couples the switch points to the switch stand. Preferably, only the switch rod needs to be replaced or modified without making any change to the rest of the railroad switch components.

Figure 4:
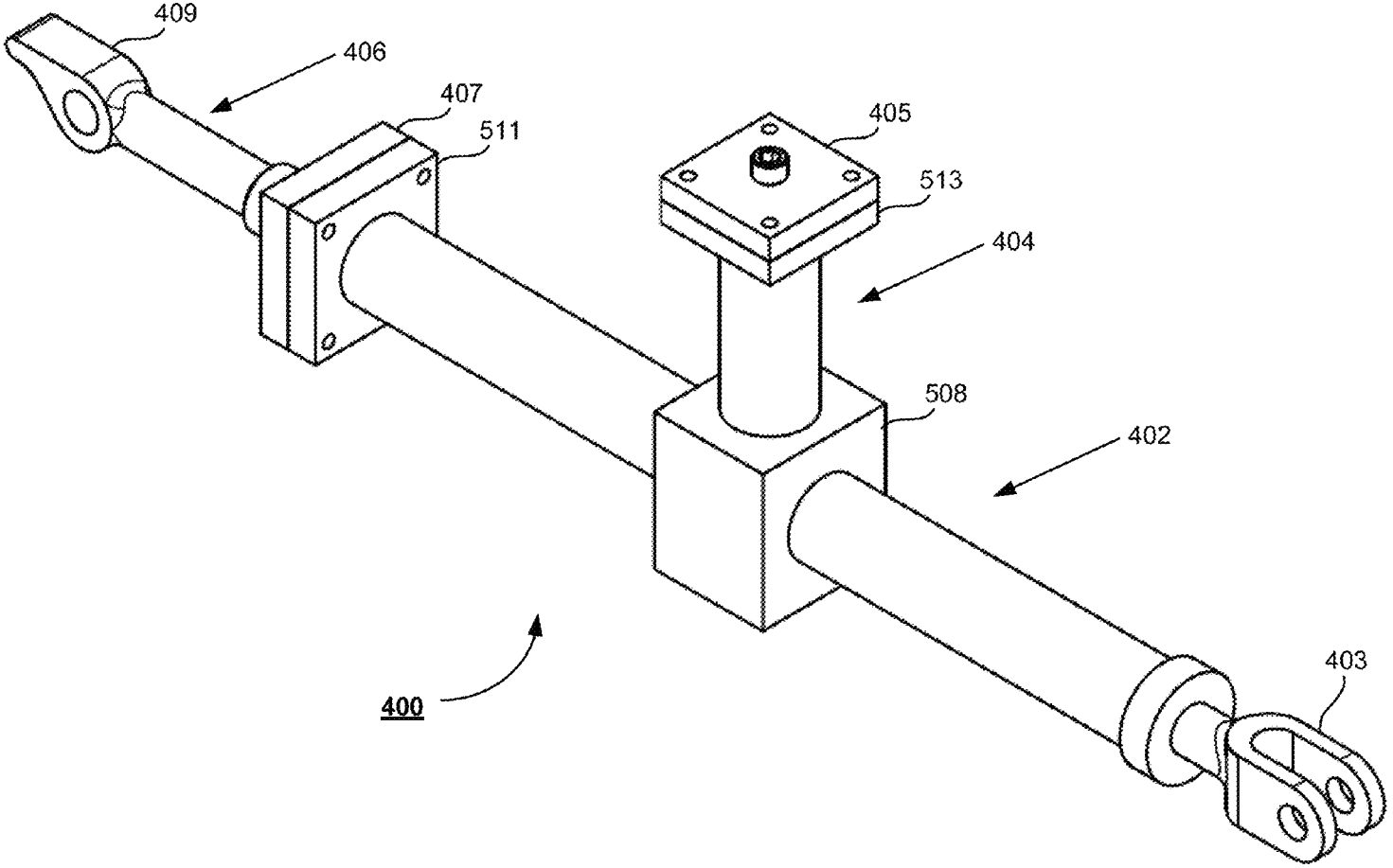
FIG. 4 shows an exemplary switch rod assembly in accordance with an embodiment of the present invention.

FIG. 4 shows an exemplary switch rod assembly in accordance with an embodiment of the present invention. The switch rod assembly 400 may comprise a switch rod housing 402, a detent assembly 404, and a connecting rod 406. Details of these main components are shown in more detail in FIGS. 5-8.

Figure 5:
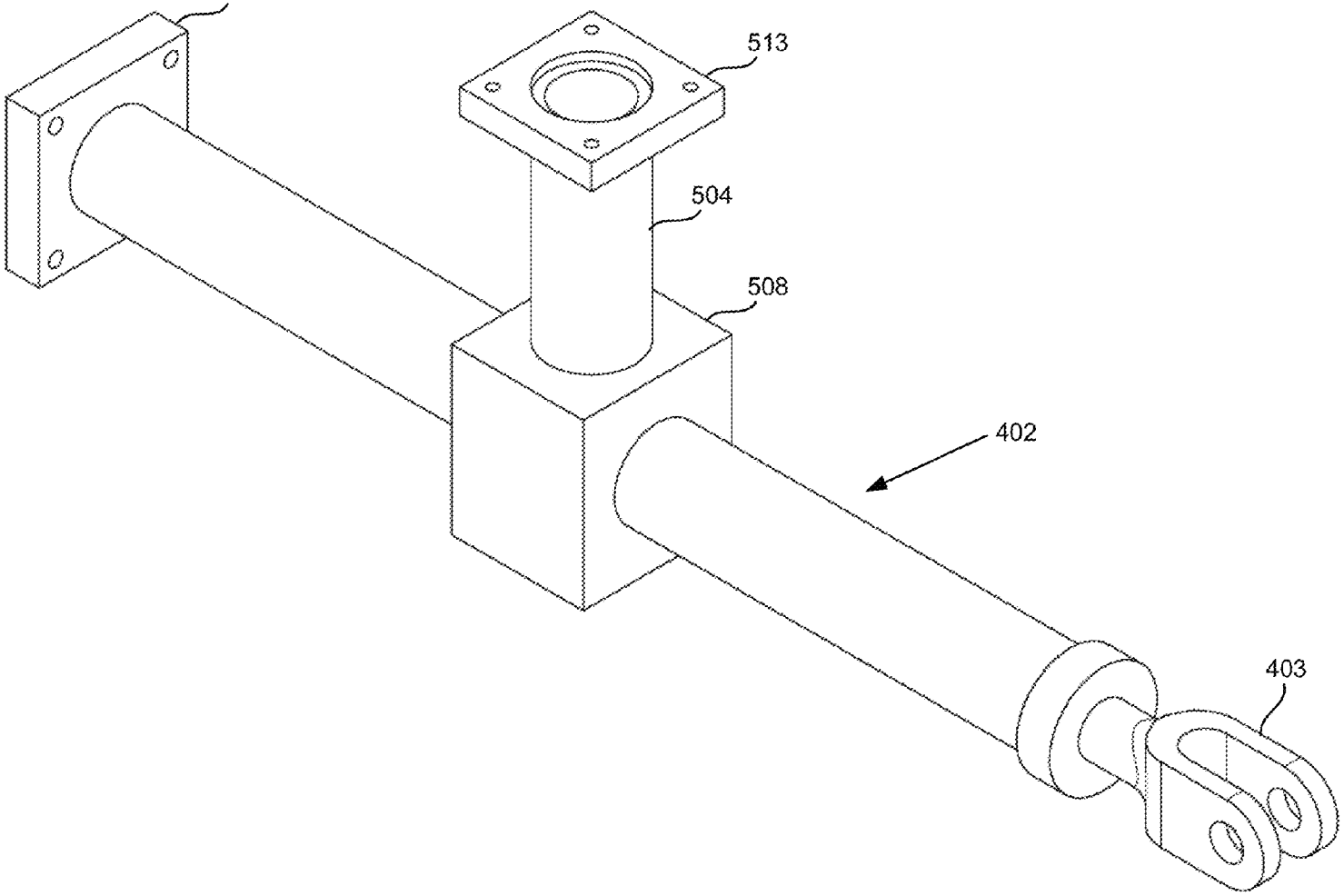
FIG. 5 shows a switch rod housing and a spring housing of an exemplary switch rod assembly in accordance with an embodiment of the present invention.

As shown in FIGS. 4 and 5, the switch rod housing 402 may be primarily a cylindrically shaped component with a hollow cavity to receive the connecting rod 406. The connecting rod 406 may be coupled to the switch rod housing 402 via a seal plate 407 attached to a first flange 511 at one end of the switch rod housing 402. The detent assembly 404 may have a cylindrically shaped housing 504 that is coupled to the switch rod housing 402 via a cubic joint 508. A top plate 405, attached to a second flange 513, may serve to secure the detent assembly 404 in its housing 504.

Figures 10A, 10B:
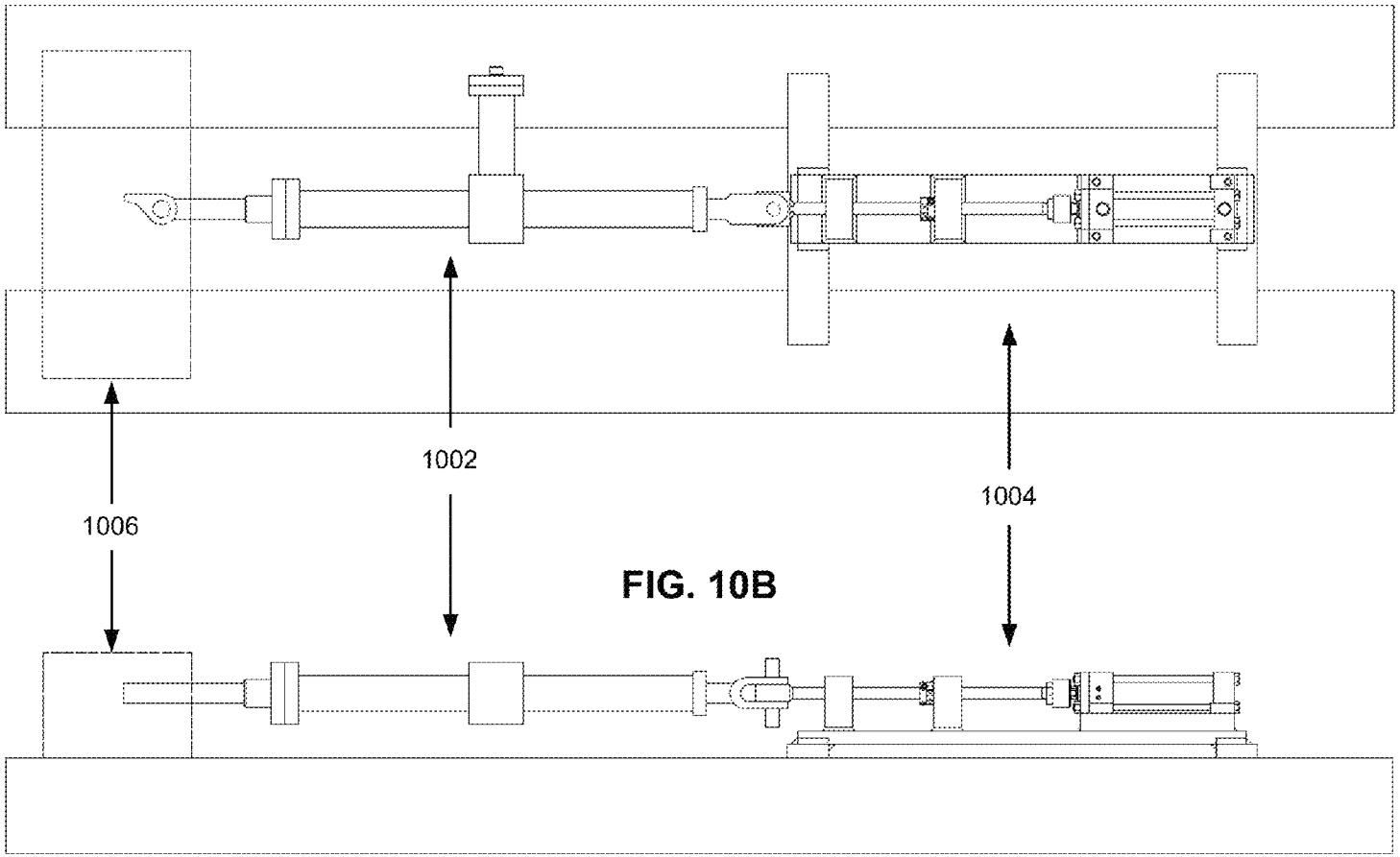
FIGS. 10A and 10B show top and side views respectively of an exemplary switch rod assembly and its installation with a test stand in accordance with an embodiment of the present invention.

The switch rod assembly 400 may be designed to replace an existing switch rod for a railroad switch assembly without requiring modifications to the rest of the railroad switch assembly or its switch stand. Accordingly, one end of the switch rod housing 402 is adapted, for example, in the shape of a fork 403 with screw or bolt holes, to couple with part of a switch assembly (not shown here); the other end (409) of the connecting rod 406 is adapted to couple with a switch stand of a railroad switch (not shown here). FIG. 10A shows a top view, and FIG. 10B shows a side view, of an exemplary switch rod assembly 1002 and its installation with a test switch stand 1006 in accordance with an embodiment of the present invention. As shown, the right end of the switch rod assembly 1002 is coupled to a railroad switch assembly 1004 while the left end of the switch rod assembly 1002 is coupled to the switch stand 1006.

Figure 6:
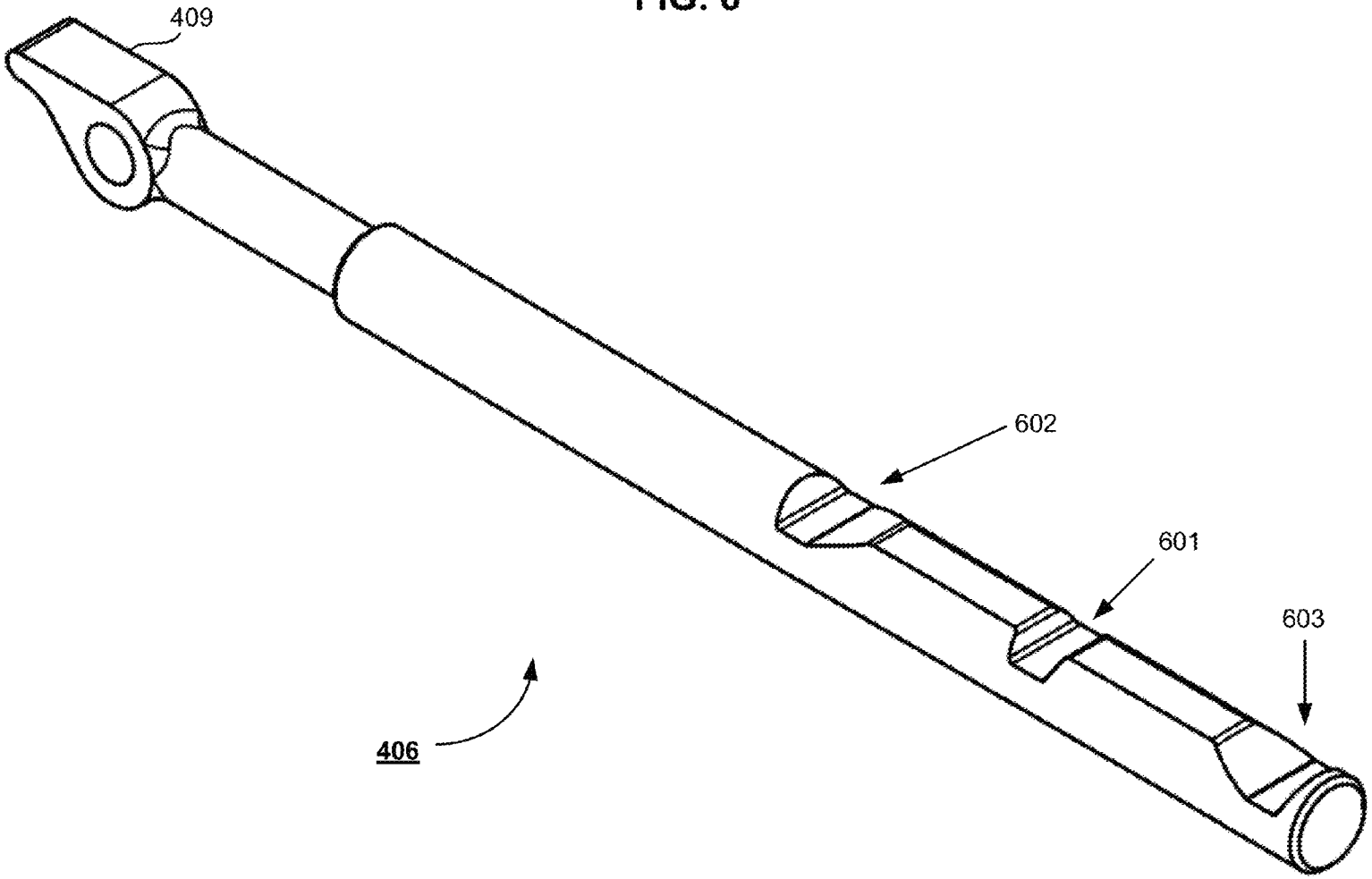
FIG. 6 shows a connecting rod of an exemplary switch rod assembly in accordance with an embodiment of the present invention.

FIG. 6 shows a connecting rod of an exemplary switch rod assembly in accordance with an embodiment of the present invention. The connecting rod 406 may be a rigid, elongated and cylindrically shaped member. As is also well known in the art, the general dimensions of the connecting rod 406 may be so configured as to fit snuggly within and be able to slide along a corresponding switch rod housing (e.g., 402). One end (409) of the connecting rod 406 may be adapted to couple with a railroad switch assembly, for example, to move its switch point. Towards the other end (i.e., the end that is inserted into the switch rod housing), two or more notches may be formed on the connecting rod 406. A first notch, 601, may have a first profile and be located at a first position on the connecting rod 406. At least one second notch, 602 or 603, may have a second profile and be located at a second position on the connecting rod 406. The profiles and relative positions of these notches are configured to work with a detent assembly, as will be described in more detail below. Between the first notch 601 and the at least one second notch 602 or 603, the connecting rod 406 may be contoured to provide a channel to guide the relative movement of a detent pin, as will also be described in more detail below.

Figure 7:
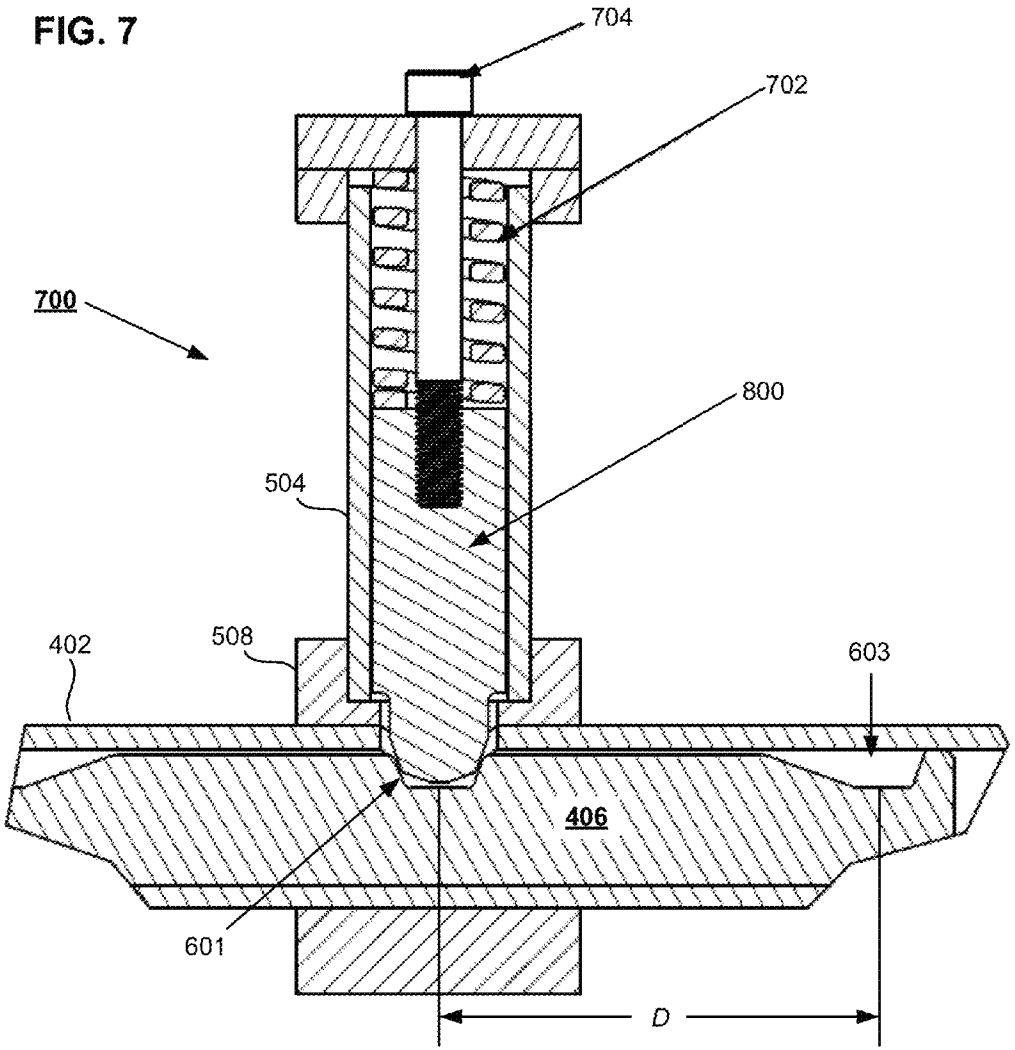
FIG. 7 shows a cross-sectional view of an exemplary spring detent assembly and its coupling to the rest of a switch rod assembly in accordance with an embodiment of the present invention.

FIG. 7 shows a cross-sectional view of an exemplary spring detent assembly and its coupling to the rest of a switch rod assembly in accordance with an embodiment of the present invention. The spring detent assembly 700 may include a detent pin 800, a bolt 704, and a spring 702, which are enclosed in a detent housing 504. The detent housing 504 may be attached to the switch rod housing 402 via the cubic joint 508 such that the center axis of the two housings are preferably perpendicular to each other. An opening in a sidewall of the switch rod housing 402 may allow at least a portion of the tip of the detent pin 800 to pass through. The spring 702 exerts a downward tension on the detent pin 800 to cause its tip to protrude through the sidewall opening of the switch rod housing 402.

Figure 8:
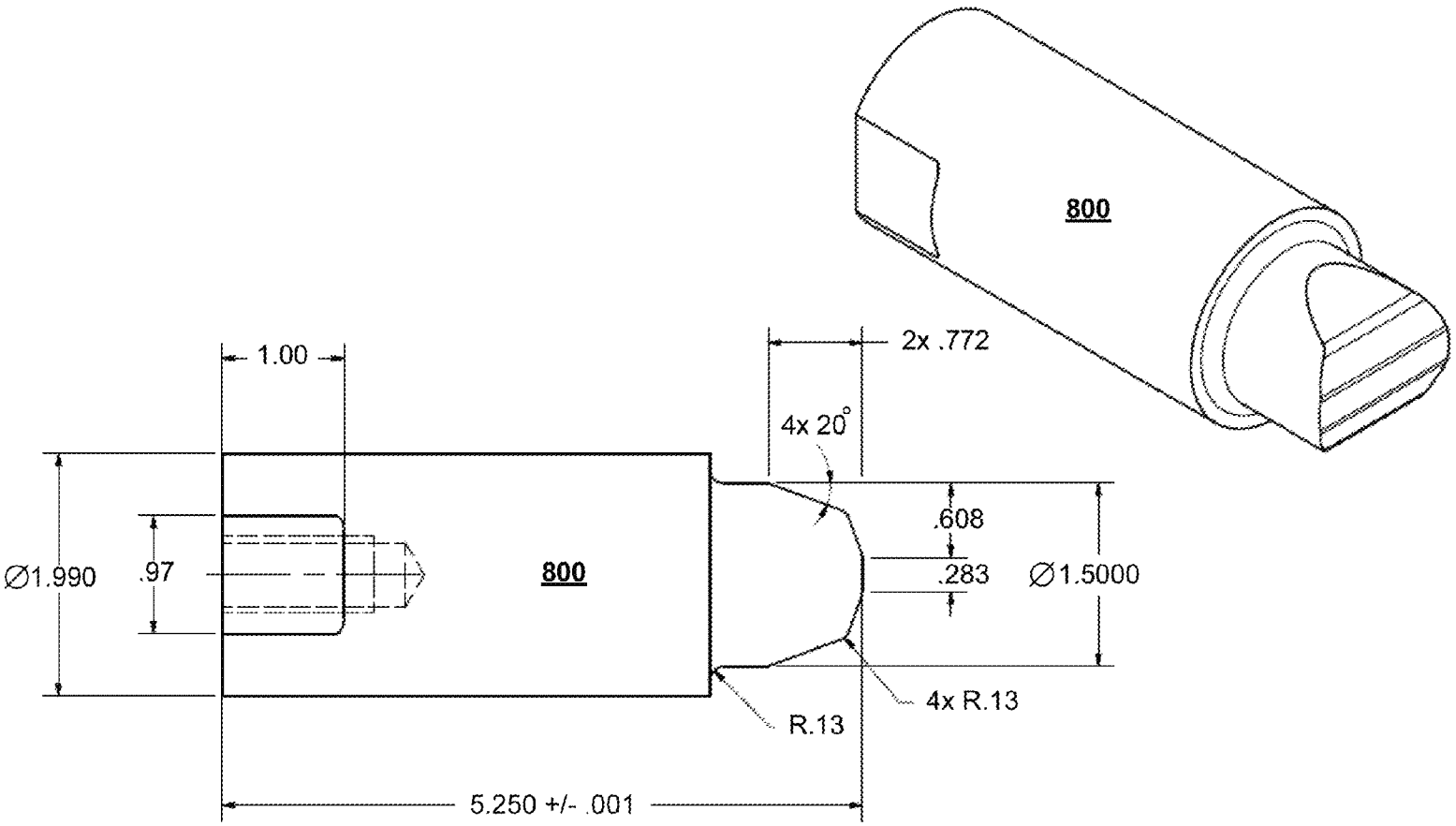
FIG. 8 shows an exemplary spring detent pin in accordance with an embodiment of the present invention.

Inside the switch rod housing 402 is slidably positioned the connecting rod 406. The notches 601-603 on the connecting rod 406 may be on the same side as the sidewall opening. As shown in FIG. 7, the first notch 601 is position at the sidewall opening now. The spring-tensioned detent pin 800 protrudes through the sidewall opening and has its tip engaged with the first notch 601. As shown in FIG. 8, the size and contour of the tip of the detent pin 800 may be so defined as to fit within the first notch 601 and press against its sidewalls to stop relative movement of the connecting rod 406 in the switch rod housing 402. The contours of the tip of the detent pin 800 and sidewalls of the first notch 601 may be further configured as to allow a significant force exerted along the connecting rod 406 to disengage the detent pin 800 from the first notch 601 and to cause the detent pin 800 to slide relative to the connecting rod 406. One example of such a significant longitudinal force may be the one caused by a train trailing through an open railroad switch. That is, the run-through may "kick" the connecting rod 406 loose from the detent pin 800 and cause it to move relative to the connecting rod towards the second notch 603. It should be noted that the specific size and contour shown in FIG. 8 are exemplary and do not represent the only design option contemplated for the present invention.

According to an embodiment of the present invention, the second notch 603 may be located a distance D away from the first notch 601 wherein the distance D is approximately the same as the travel distance of the switch point of the railroad switch when it is toggled from one state to the other (e.g., from "fully open" to "fully closed"). Accordingly, when a run-through train forces the railroad switch into a different state, for example, by jerking the connecting rod 406 to the left, the detent pin 800 will be knocked out of the first notch 601 and finally land in the second notch 603. As shown in FIG. 7, the sidewall of the second notch 603 on the right hand side is relatively steep and may fully stop the connecting rod 406 from traveling any further to the left. By engaging the second notch 603 with the detent pin 800, the connecting rod 406 can securely maintain the railroad switch in the same run-through position.

Figure 9A:
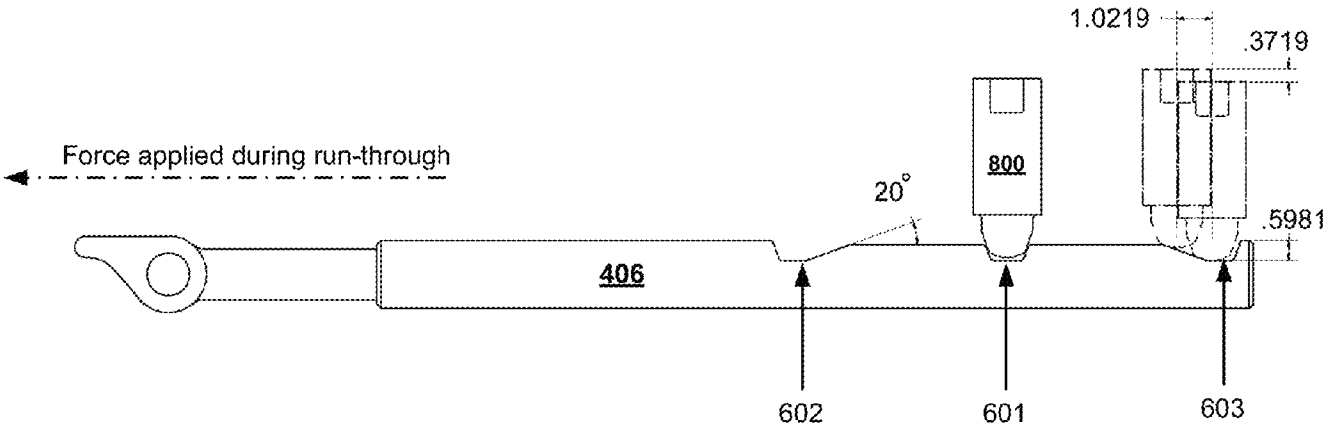
FIGS. 9A-9B show side views of an exemplary detent pin and connecting rod in accordance with an embodiment of the present invention.
Figure 9B:
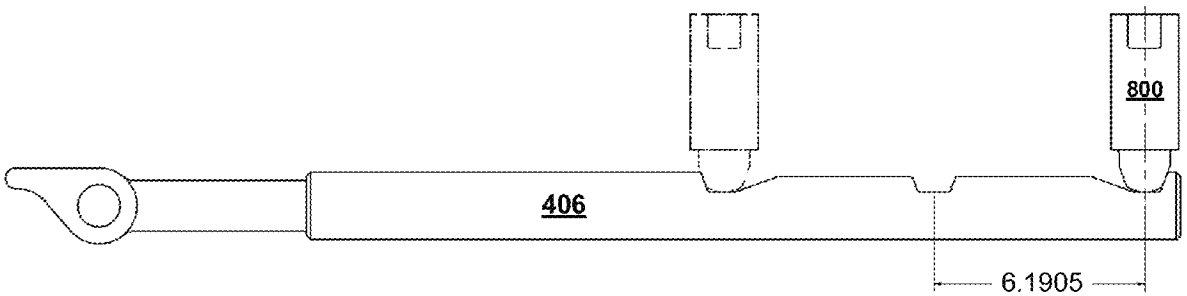

This operation is illustrated more clearly in FIGS. 9A-9B. FIG. 9A shows a side view of the exemplary detent pin 800 and connecting rod 406 when the railroad switch is in a first operating state. At this moment, the detent pin 800 engages with the first notch 601 to hold the switch in a normal condition. The first notch 601 may mark the reset (or normal operational) position of the detent pin 800. The force applied by the train wheels during the run-through is sufficient to knock the tip of the detent pin 800 out of the first notch 601 and therefore causes the connecting rod 406 to slide to the left hand side until the detent pin 800 is stopped by the second notch 603. FIG. 9B shows a side view of the exemplary detent pin 800 and connecting rod 406 when the railroad switch is locked in this second operating state after the run-through. The notch 603 may mark the right-lock position of the detent pin 800. While, in this example, the run-through train forces the connecting rod 406 to move to the left, the same principle of operation applies when the connecting rod 406 is forced to the right hand side by a run-through train. In that case, the notch 602 located to the left side of the first notch 601 may accommodate and stop the detent pin 800. The notch 602 may mark the left-lock position of the detent pin 800.

FIGS. 11A-11D show different operating states of an exemplary switch rod assembly in accordance with an embodiment of the present invention. In these drawings, the setup illustrated in FIGS. 10A-10B is presented in cross-sectional views to show how the switch rod assembly 1002 is used and operates in connection with the test switch stand 1006 and the switch assembly 1004.

Figure 11A:
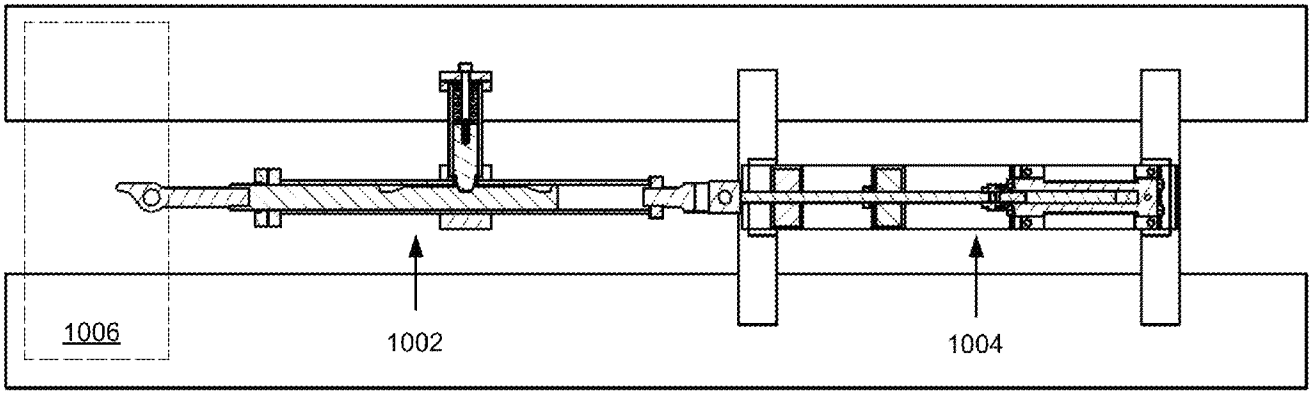
FIGS. 11A-11D show different operating states of an exemplary switch rod assembly in accordance with an embodiment of the present invention.

FIG. 11A shows the switch rod assembly 1002 in its normal operational state when the detent pin is engaged in the reset position. The switch rod assembly 1002 now may function like a conventional switch rod. Routine toggling of the switch assembly 1004 by operating the switch stand 1006 will not affect the position of the detent pin. Thus, the entire length of the switch rod assembly 1002 remains the same during normal operations.

Figure 11B:
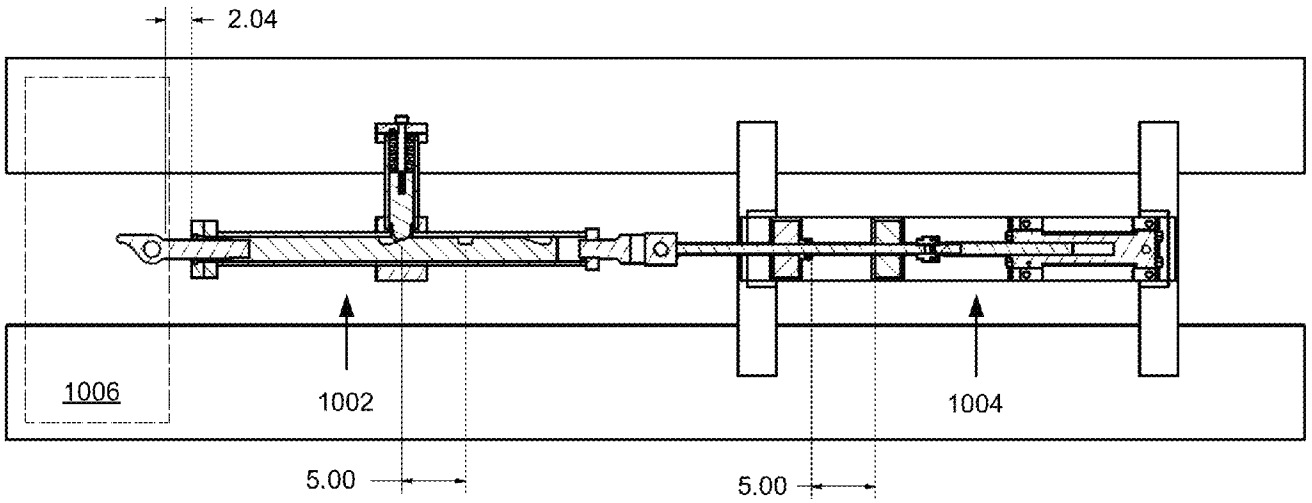

FIG. 11B shows the switch rod assembly 1002 in what is referred to as a "detent short" state when the detent pin is dislodged from the reset position and rests in the left-lock position. This may be due to a run-through of the switch assembly 1004 which forces the connecting rod to move to the right relative to the switch rod housing. As shown in FIG. 11B (and in FIG. 11D), the maximum travel that the switch point can move is approximately five inches according to this embodiment.

Figure 11C:
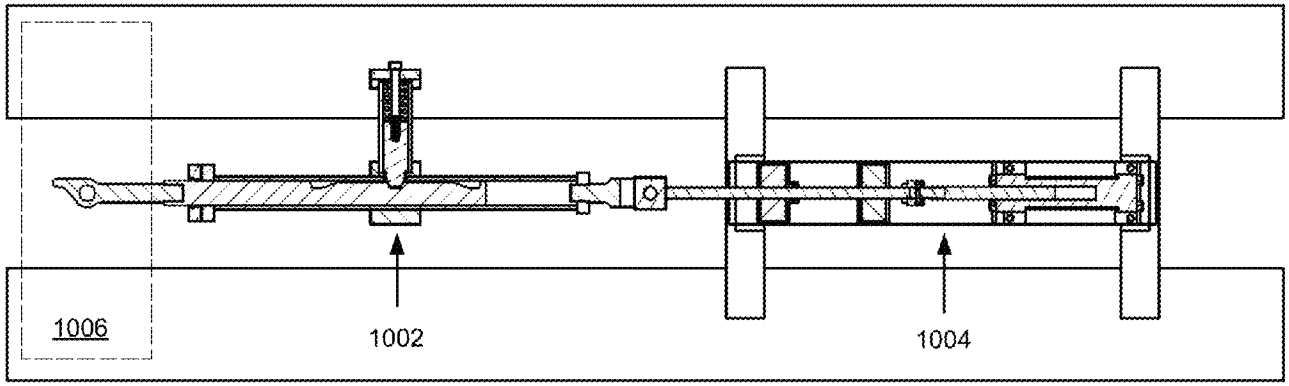

FIG. 11C shows the switch rod assembly 1002 after it is returned to the operational state. The notch profile at the left-lock position (FIG. 11B) may allow connecting rod to be pulled to the left, thereby causing the detent pin to be re-engaged in the reset position.

Figure 11D:
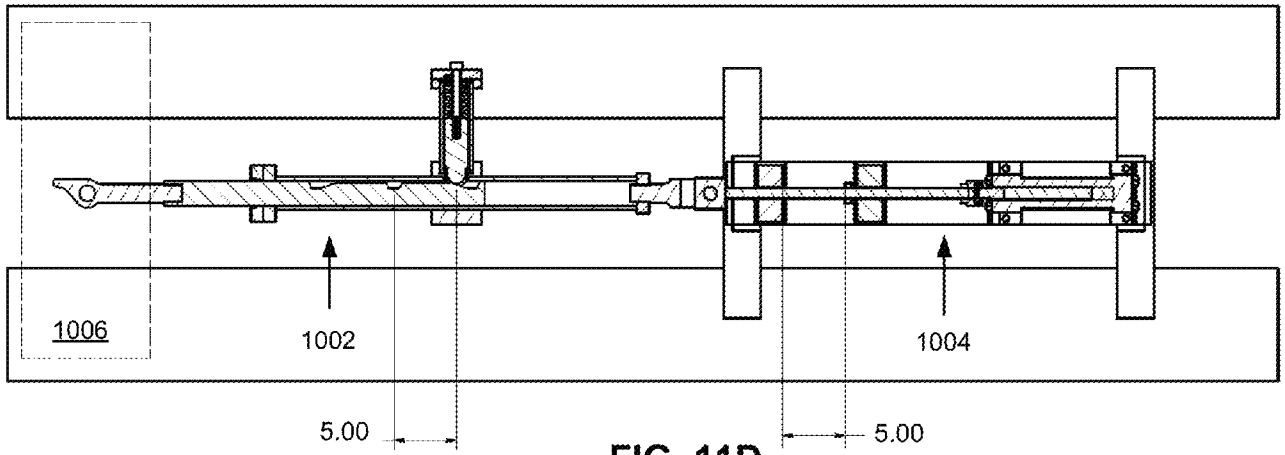

FIG. 11D shows the switch rod assembly 1002 in what is referred to as a "detent long" state when the detent pin is dislodged from the reset position and rests in the right lock position. This may be due to a run-through of the switch assembly 1004 which forces the connecting rod to move to the left relative to the switch rod housing.

Figure 12:
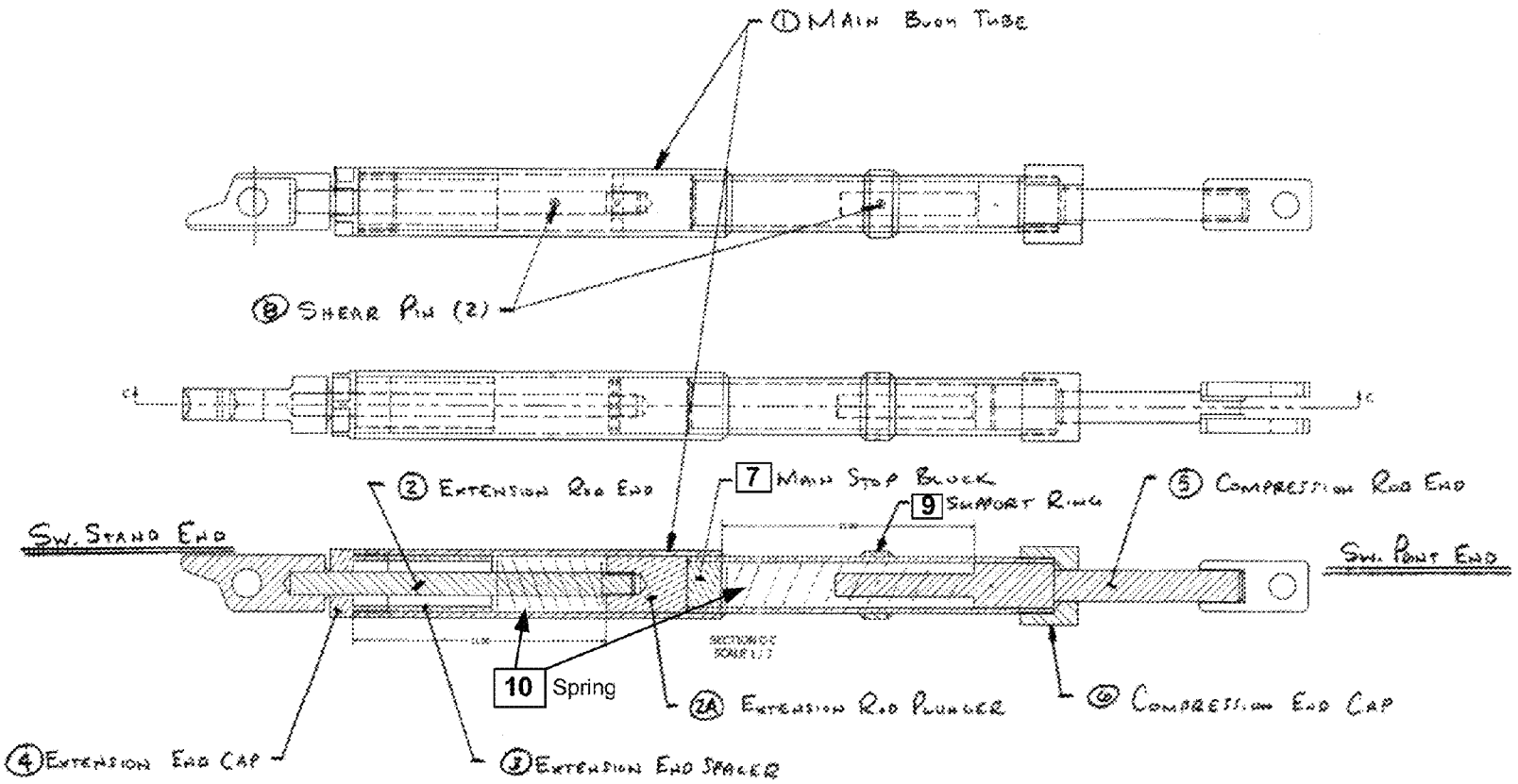
FIGS. 12 and 13 show the design and operation of another exemplary switch rod assembly in accordance with an alternative embodiment of the present invention.
Figure 13:
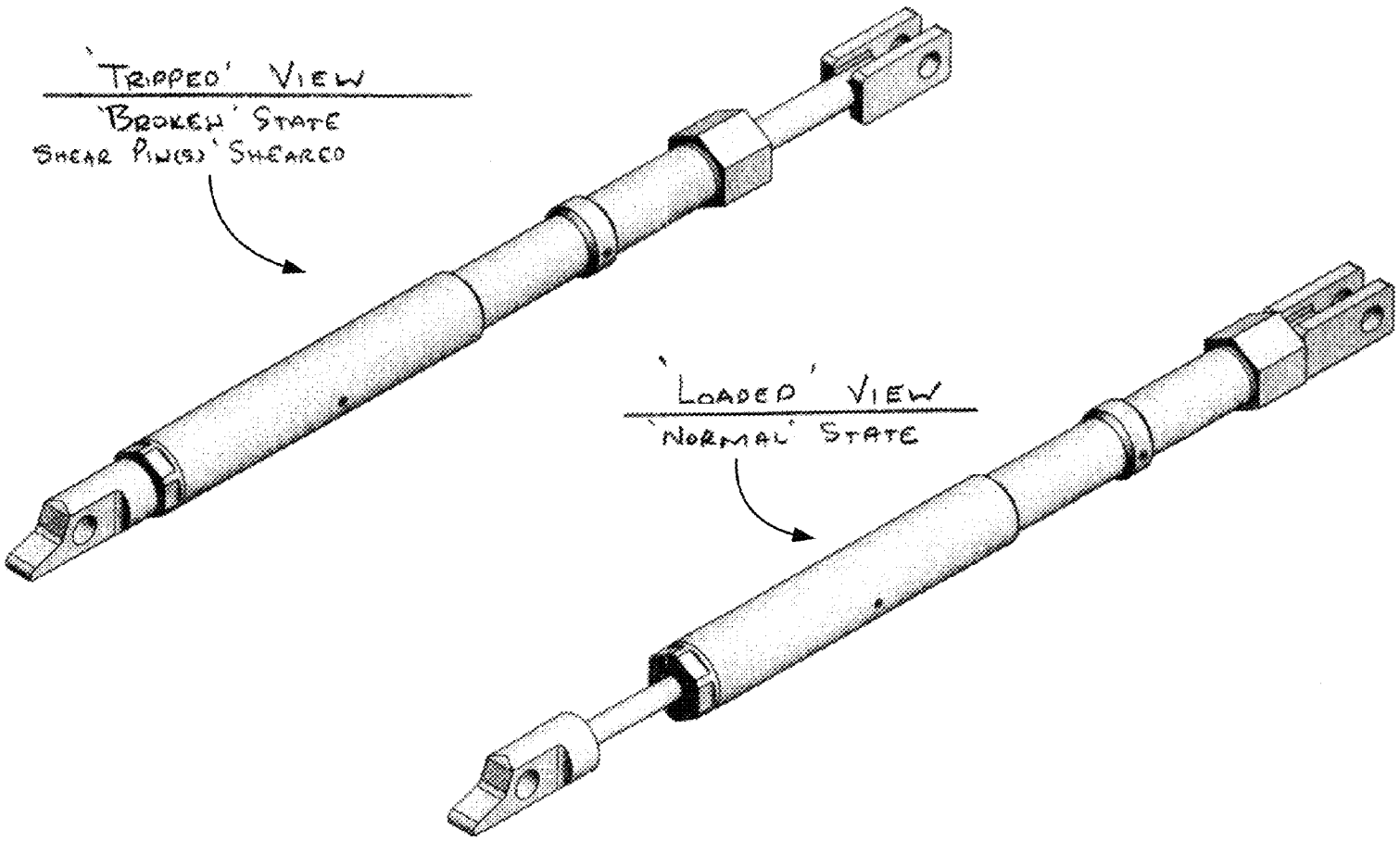

FIGS. 12 and 13 show the design and operation of another exemplary switch rod assembly in accordance with an alternative embodiment of the present invention. As shown in FIG. 12, this alternative design of switch rod assembly may include a main body tube 1 that accommodates an extension rod end 2 on the switch stand side and a compression rod end 5 on the switch point side. Spring(s) 10 may be used to configure the switch rod in a predetermined state while shear pin(s) 8 may maintain the switch rod in that ("loaded") state. When a run-through occurs, the switch rod will experience a significant longitudinal force which causes the shear pin(s) 8 to be broken and thereby release the compressed/extended spring(s) 10. As a result, the spring(s) 10 may cause the switch rod to stay in the run-through direction even after the train has completely passed the switch location.

For example, in the normal state ("loaded view") shown in FIG. 13, the spring 10 on the extension rod end may by kept fully compressed (due to the corresponding shear pin 8), whereas the spring 10 on the compression rod end may by kept fully extended (also due to the corresponding shear pin 8). If the run-through train exerts a force that moves the switch point towards the switch stand (that is, compressing the switch rod overall), then at least the shear pin 8 on the compression rod end would break and cause the corresponding spring 10 to compress to its natural length, thereby causing the switch rod to stay in the broken state ("tripped view") shown in FIG. 13.

It should be noted that the above-described switch rod assembly need not be one that is constructed complete from scratch. Where applicable, some existing switch rods could be modified ("retrofitted") based on the operating principles described herein.

While the foregoing description includes many details and specificities, it is to be understood that these have been included for purposes of explanation only, and are not to be interpreted as limitations of the present invention. It will be apparent to those skilled in the art that other modifications to the embodiments described above can be made without departing from the spirit and scope of the invention. Accordingly, such modifications are considered within the scope of the invention as intended to be encompassed by the following claims and their legal equivalents.

The invention claimed is:

1. A railroad switch rod assembly, comprising:

a switch rod housing having a first end adapted to couple with a switch point of a railroad switch, the switch rod housing further having a second end adapted to slidably receive a connecting rod into the switch rod housing;

a detent assembly coupled to the switch rod housing, the detent assembly comprising a detent pin; and the connecting rod, one end of the connecting rod being adapted to couple with a railroad switch stand, the connecting rod having (a) a first notch to receive a tip of the detent pin in a first operating state of the railroad switch to maintain a first relative position of the connecting rod in the switch rod housing and (b) a second notch to receive the tip of the detent pin in a second operating state of the railroad switch to maintain a second relative position of the connecting rod in the switch rod housing, wherein a first sidewall of the second notch is steeply sloped to stop the detent pin from sliding further along the connecting rod, and wherein a second sidewall of the second notch is less steeply sloped than the first sidewall to allow a sliding motion of the connecting rod to disengage the detent pin from the second notch and cause the detent pin to re-engage with the first notch.

2. The railroad switch rod assembly according to claim 1, wherein the detent pin is spring-loaded in the detent assembly.

3. The railroad switch rod assembly according to claim 1, wherein the tip of the detent pin protrudes through an opening in a sidewall of the switch rod housing to engage with the first notch and the second notch.

4. The railroad switch rod assembly according to claim 1, wherein contours of the tip of the detent pin and sidewalls of the first notch are so configured as to allow a significant force exerted along the connecting rod to disengage the detent pin from the first notch and to cause the detent pin to slide relative to the connecting rod towards the second notch.

5. A railroad switch system comprising the railroad switch rod assembly of claim 1.

6. A method of using the railroad switch rod assembly of claim 1, the method comprising:

causing the detent pin to engage with the first notch on the connecting rod so as to maintain the railroad switch in the first operating state; and installing the railroad switch rod assembly to couple the switch point of the railroad switch with the railroad switch stand.

7. The method according to claim 6, further comprising:

resetting the railroad switch rod assembly causing the detent pin to engage with the first notch on the connecting rod after the railroad switch is run through.

8. A method of making a railroad switch rod assembly, the method comprising:

forming a switch rod housing having a first end adapted to couple with a switch point of a railroad switch and a second end adapted to slidably receive a connecting rod into the switch rod housing;

coupling a detent assembly to the switch rod housing, the detent assembly comprising a detent pin;

adapting one end of the connecting rod the connecting rod to couple with a railroad switch stand;

forming a first notch and a second notch in the connecting rod, the first notch being adapted to receive a tip of the detent pin in a first operating state of the railroad switch to maintain a first relative position of the connecting rod in the switch rod housing, and the second notch being adapted to receive the tip of the detent pin in a second operating state of the railroad switch to maintain a second relative position of the connecting rod in the switch rod housing, wherein first sidewall of the second notch is steeply sloped to stop the detent pin from sliding further along the connecting rod, and wherein a second sidewall of the second notch is less steeply sloped than the first sidewall to allow a sliding motion of the connecting rod to disengage the detent pin from the second notch and cause the detent pin to re-engage with the first notch; and assembling the connecting rod with the switch rod housing.

9. A method of using a railroad switch rod assembly, the method comprising:

providing a railroad switch rod assembly comprising:

a switch rod housing having a first end adapted to couple with a switch point of a railroad switch, the switch rod housing further having a second end adapted to slidably receive a connecting rod into the switch rod housing, a detent assembly coupled to the switch rod housing, the detent assembly comprising a detent pin, and the connecting rod, one end of the connecting rod being adapted to couple with a railroad switch stand, the connecting rod having (a) a first notch to receive a tip of the detent pin in a first operating state of the railroad switch to maintain a first relative position of the connecting rod in the switch rod housing and (b) a second notch to receive the tip of the detent pin in a second operating state of the railroad switch to maintain a second relative position of the connecting rod in the switch rod housing, wherein a first sidewall of the second notch is steeply sloped to stop the detent pin from sliding further along the connecting rod, and wherein a second sidewall of the second notch is less steeply sloped than the first sidewall to allow a sliding motion of the connecting rod to disengage the detent pin from the second notch and cause the detent pin to re-engage with the first notch; and installing the railroad switch rod assembly to couple the switch point of the railroad switch with the railroad switch stand, the installing further comprising causing the detent pin to engage with the first notch on the connecting rod so as to maintain the railroad switch in the first operating state.

10. A railroad switch rod assembly, comprising:

a switch rod housing having a first end adapted to couple with a railroad switch stand, the switch rod housing further having a second end adapted to slidably receive a connecting rod into the switch rod housing;

a detent assembly coupled to the switch rod housing, the detent assembly comprising a detent pin; and the connecting rod, one end of the connecting rod being adapted to couple with a switch point of a railroad switch, the connecting rod having (a) a first notch to receive a tip of the detent pin in a first operating state of the railroad switch to maintain a first relative position of the connecting rod in the switch rod housing and (b) a second notch to receive the tip of the detent pin in a second operating state of the railroad switch to maintain a second relative position of the connecting rod in the switch rod housing, wherein a first sidewall of the second notch is steeply sloped to stop the detent pin from sliding further along the connecting rod, and wherein a second sidewall of the second notch is less steeply sloped than the first sidewall to allow a sliding motion of the connecting rod to disengage the detent pin from the second notch and cause the detent pin to re-engage with the first notch.

11. A method of making a railroad switch rod assembly, the method comprising:

forming a switch rod housing having a first end adapted to couple with a railroad switch stand and a second end adapted to slidably receive a connecting rod into the switch rod housing;

coupling a detent assembly to the switch rod housing, the detent assembly comprising a detent pin;

adapting one end of the connecting rod the connecting rod to couple with a switch point of a railroad switch;

forming a first notch and a second notch in the connecting rod, the first notch being adapted to receive a tip of the detent pin in a first operating state of the railroad switch to maintain a first relative position of the connecting rod in the switch rod housing, and the second notch being adapted to receive the tip of the detent pin in a second operating state of the railroad switch to maintain a second relative position of the connecting rod in the switch rod housing, wherein a first sidewall of the second notch is steeply sloped to stop the detent pin from sliding further along the connecting rod, and wherein a second sidewall of the second notch is less steeply sloped than the first sidewall to allow a sliding motion of the connecting rod to disengage the detent pin from the second notch and cause the detent pin to re-engage with the first notch; and assembling the connecting rod with the switch rod housing.

12. A method of using a railroad switch rod assembly, the method comprising:

providing a railroad switch rod assembly comprising:

a switch rod housing having a first end adapted to couple with a railroad switch stand, the switch rod housing further having a second end adapted to slidably receive a connecting rod into the switch rod housing, a detent assembly coupled to the switch rod housing, the detent assembly comprising a detent pin, and the connecting rod, one end of the connecting rod being adapted to couple with a switch point of a railroad switch, the connecting rod having (a) a first notch to receive a tip of the detent pin in a first operating state of the railroad switch to maintain a first relative position of the connecting rod in the switch rod housing and (b) a second notch to receive the tip of the detent pin in a second operating state of the railroad switch to maintain a second relative position of the connecting rod in the switch rod housing, wherein a first sidewall of the second notch is steeply sloped to stop the detent pin from sliding further along the connecting rod, and wherein a second sidewall of the second notch is less steeply sloped than the first sidewall to allow a sliding motion of the connecting rod to disengage the detent pin from the second notch and cause the detent pin to re-engage with the first notch; and installing the railroad switch rod assembly to couple the switch point of the railroad switch with the railroad switch stand, the installing further comprising causing the detent pin to engage with the first notch on the connecting rod so as to maintain the railroad switch in the first operating state.

* * * * *